US009689121B2

(12) United States Patent
Shi et al.

(10) Patent No.: US 9,689,121 B2
(45) Date of Patent: Jun. 27, 2017

(54) PISTON-TYPE VARIABLE SPEED CONTROL DEVICE

(71) Applicants: Jianjun Shi, Beijing (CN); Jizhen Guan, Beijing (CN); Yafei Liu, Beijing (CN)

(72) Inventors: Jianjun Shi, Beijing (CN); Jizhen Guan, Beijing (CN); Yafei Liu, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 486 days.

(21) Appl. No.: 14/354,585

(22) PCT Filed: Mar. 7, 2013

(86) PCT No.: PCT/CN2013/072266

§ 371 (c)(1),
(2) Date: Apr. 27, 2014

(87) PCT Pub. No.: WO2014/117420

PCT Pub. Date: Aug. 7, 2014

(65) Prior Publication Data

US 2016/0312416 A1 Oct. 27, 2016

(30) Foreign Application Priority Data

Jan. 31, 2013 (CN) ..... 2013 1 0038925

(51) Int. Cl.
*E01F 9/529* (2016.01)

(52) U.S. Cl.
CPC ..... *E01F 9/529* (2016.02)

(58) Field of Classification Search
CPC ..... E01F 9/00; E01F 9/047; E01F 9/529
USPC ..... 404/15
See application file for complete search history.

(56) References Cited

U.S. PATENT DOCUMENTS 4,342,525 A * 8/1982 Mastronuzzi, Jr. ..... E01F 9/529 404/6
5,267,808 A * 12/1993 Welford ..... E01F 9/529 404/11
5,509,753 A * 4/1996 Thompson ..... E01F 9/529 404/11
6,241,419 B1 * 6/2001 Bond ..... E01F 9/529 404/10

(Continued)

*Primary Examiner* — Gary Hartmann
(74) *Attorney, Agent, or Firm* — Han IP Corporation; Andy M. Han

(57) ABSTRACT

A piston-type variable-speed control device. The piston-type variable-speed control device comprises a plurality of piston-type speed bump structure apparatuses installed on a road surface, a vehicle speed detection device, a speed controller and an electrical power supply. Each of the piston-type speed bump structure apparatuses comprises a ridge platform. A height by which the ridge platform is raised, a time to raise the ridge platform, and a duration for which the ridge platform is raised are controllable to cause a jolting motion to one or more front wheels, one or more rear wheels, or a single wheel of a speeding vehicle. When the speed of a passing vehicle exceeds a predetermined speed limit, the piston-type speed bump structure apparatuses stay at moderately raised position to cause an obvious yet safe jolting motion to the passing vehicle.

10 Claims, 7 Drawing Sheets

(56) References Cited

U.S. PATENT DOCUMENTS

| | | | | |
|---|---|---|---|---|
| 6,457,900 | B2 * | 10/2002 | Bond | E01F 9/529 404/15 |
| 7,011,470 | B1 * | 3/2006 | Breazeale | E01F 9/529 404/10 |
| 7,114,873 | B2 * | 10/2006 | Rastegar | E01F 9/529 404/6 |
| 7,507,052 | B2 * | 3/2009 | Griffiths | E01F 9/529 404/11 |
| 7,645,090 | B2 * | 1/2010 | Rastegar | E01F 9/529 404/15 |
| 9,410,297 | B2 * | 8/2016 | Ustrell I Mussons | E01C 9/00 |
| 2008/0056818 | A1 * | 3/2008 | Rastegar | E01F 9/529 404/15 |
| 2012/0282024 | A1 * | 11/2012 | Hua | E01F 9/529 404/15 |
| 2013/0209169 | A1 * | 8/2013 | Chew | E01F 9/529 404/15 |

* cited by examiner

PISTON-TYPE VARIABLE SPEED CONTROL DEVICE

CROSS REFERENCE TO RELATED APPLICATION

This application is a national stage application of International application number PCT/CN2013/072266, filed Mar. 7, 2013, which claims the priority benefit of Chinese Patent Application No. 201310038925.0, filed on Jan. 31, 2013, which is hereby incorporated by reference in its entirety.

TECHNICAL FIELD

The present disclosure relates to the fields of traffic, machinery and electronics, and more particularly relates to an electromechanical control device used in a road traffic system. This electromechanical control device restricts drivers from driving over the speed limit by visual alerts and the vehicle's jolting motion.

BACKGROUND

Limiting speed of a motor vehicle on a road is a common traffic management method that ensures traffic safety and reduces accidents. With the rapid development of traffic control and the widespread use of intelligent traffic control technology, limiting speed of a motor vehicle on certain roads gradually becomes an important control means to regulate traffic flow and road capacity, and to balance traffic flow of a road system.

In prior art, the common methods used for limiting speed of a motor vehicle include a dynamic and static speed limit sign, pavement markings, a speed bump, and so on. The speed limit signs and pavement markings only act as a reminder for speed control and are not effective in slowing down traffic. A speed bump is a raised ridge on a roadway and usually is made of material such as metal or rubber. A speed bump forces a vehicle to slow down by causing an uncomfortable jolting motion. A speed bump can only force a vehicle to slow down; however, it cannot achieve speed control. Installing a speed bump on a roadway tends to generate not only noise pollution, but also tends to increase the amount of exhaust emission and will create unnecessary environmental pollution. In addition, it may create potential safety problems. When a vehicle passes a speed bump at high speed the speed bump may cause a strong jolting motion to the vehicle. In worst case that strong jolting motion could cause damage to the vehicle or goods inside, and cause injury to the passengers considerably. It may even cause traffic accidents. The speed bump cannot be used widely for traffic control.

In the process of traffic management and control, speed control of vehicles is achieved by the effective restriction of a driver's driving behaviors. The present disclosure provides a technique that controls a driver from speeding by utilizing an electromechanical control device according to the driver's driving behavior. The present disclosure regulates traffic flow effectively while ensuring traffic safety.

SUMMARY

For road traffic safety and demand for intelligent traffic management and control of vehicle speed, the present disclosure provides a piston-type vehicle speed control device that is installed on a road surface. The piston-type vehicle speed control device can be configured with a speed limit manually or by a traffic control system automatically through a communication network. With striking visual warning and speed limit alerts the present disclosure allows smooth passage of a non-speeding vehicle and safe passage of a speeding vehicle with jolting motion to achieve vehicle speed control.

A piston-type variable speed control device includes a plurality of piston-type speed bump structure apparatuses 1 which is installed in the road surface, a vehicle speed detection device 2, a speed controller 3, a display screen 4, and an electrical power supply 5, wherein piston-type speed bump structure apparatuses 1 and vehicle speed detection device 2 are respectively communicatively connected with the speed controller 3, and the speed controller 3 is connected with display screen 4 and electrical power supply 5.

The piston-type speed control device is composed of two or more independent piston-type speed bump structure apparatuses 1. In each of piston-type speed bump structure apparatuses 1 a ridge platform 6 is raised on the road surface at its initial state and its surface is covered with a yellow and black striped rubber material 14, wherein a plurality of pistons 9, a plurality of piston rods 7 and a plurality of fluid cylinders 8 are placed under the ridge platform 6. Ridge platform 6 is connected with pistons 9 via piston rods 7, wherein each of pistons 9 is contained in one of sealed fluid cylinders 8. A rubber seal ring 10 is placed at the joint point of each of piston rods 7 and each of fluid cylinders 8 and a piston ring 11 is placed on each of the pistons 9. A fluid inlet and outlet I 19 and a fluid inlet and outlet II 20 at the side surface of each of fluid cylinders 8 are connected with a pump 15 by a pipeline 17. Each of fluid cylinders 8 is connected with a fixed base 23 underneath. Fluid cylinders 8, pipeline 17, and pump 15 are filled with a fluid 22. Movement of pistons 9 is controlled by fluid 22. Pump 15 is connected with electrical power supply 5 through the speed controller 3. Vehicle speed detection device 2 is communicatively connected with speed controller 3 via a wireless signal receiver 16.

The parameters of display screen 4 can be modified manually or by a speed control system through a network.

The height of ridge platform 6, the time to raise ridge platform 6, and the duration at the raised position are controllable in order to cause jolting motion to the front wheels, the rear wheels, or a single wheel of a speeding vehicle.

There is filler 24 between piston-type speed bump structure apparatuses 1 and speed controller 3. The top of each piston-type speed bump structure apparatus 1 is covered with a adhesive sponge buffer layer 18 and piston-type speed bump structure apparatuses 1 are fixed on base 23. A steel protective layer 12 is placed between the ground and base 23. A pin 13 is used to connect base 23 to steel protective layer 12.

Fluid cylinders 8 in each piston-type speed bump structure apparatus 1 are made of a steel material. Fluid cylinders 8, pipeline 17, and pump 15 form an entire closed system.

The height of ridge platform 6 of piston-type speed bump structure apparatuses 1 can be controlled and can cause jolting motion to the front wheels, the rear wheels or a single wheel of a speeding vehicle.

A ground loop speed detector is used in vehicle speed detection device 2 which consists of a threaded sealing cover, a detection circuit board, a high efficient battery pack, a casing, and a signal receiver.

When a vehicle passes through the ground loop of vehicle speed detection device 2, the speed of the vehicle speed is detected by the detection circuit board of vehicle speed detection device 2 in real time. The signal receiver 16 transmits the speed detected to an input circuit of speed controller 3 and then a central processing unit decides whether the vehicle is speeding.

When a vehicle speed exceeds the speed limit set by the present disclosure, the speed controller 3 disconnects electrical power supply 5. As a result fluid 22 in the lower parts of pistons 9 in fluid cylinders 8 pushes against pistons 9 and ridge platforms 6 cannot be pushed down. Thus the vehicle receives an obvious jolting motion. When a vehicle passes through the present disclosure under the speed limit, the speed controller 3 connects the power supply 5 to supply appropriate current to pump 15. As a result fluid 22 in the lower parts of pistons 9 in fluid cylinders 8 flows into the upper parts of fluid cylinders 8 from fluid inlet and outlet II 20 through pump 15, wherein pump 15 is connected with fluid inlet and outlet I 19, so that ridge platform 6 are pushed down. Thus the vehicle can pass smoothly with no bumpy (jolting) motion. The height of ridge platform 6 is controlled by the speed controller 3 and can cause jolting motion to the front wheels, the rear wheels, or a single wheel of a speeding vehicle.

The present disclosure has the following advantages:

In the present disclosure the speed control device has a raised platform design and its surface is covered with striking anti-rolling rubber. It creates visual effect to a driver as a normal speed bump. The black and yellow colored anti-rolling rubber surface creates a strong visual effect of alerting. Sponge filler inside the speed control device prevent gravel, trash, rainwater, and other things to get into the speed control device and ensures reliability of the speed control device. The steel protective layer inside the speed control device and the sponge buffer layer at the top of the piston-type speed bump structure apparatuses can reduce vehicle impact on the ridge platform and make the device more durable. The speed controller can control the ridge platform to raise in certain height according to the real-time speed of a vehicle in order to cause jolting motion to a vehicle and at the same time through the controlling of the height of the ridge platform the present disclosure can create jolting motion to the front wheels, the rear wheels, or single wheel of a vehicle. The display screen can change road speed limit in real time through a traffic manager or a communication network according to safety requirement or traffic flow control requirement. The present disclosure has the advantage of causing jolting motion to a speeding vehicle and letting other vehicles pass smoothly. The display screen can dynamically show road speed limit and alert driver to slow down and to drive safely. The present disclosure not only reminds a speeding driver of road speed limit, but also reduces impact to vehicles passing under speed limit, damage to a vehicle, environmental pollution, and noise created by vehicles. The present disclosure has achieved safety and user-friendly design of a speed control device.

Figure 1:
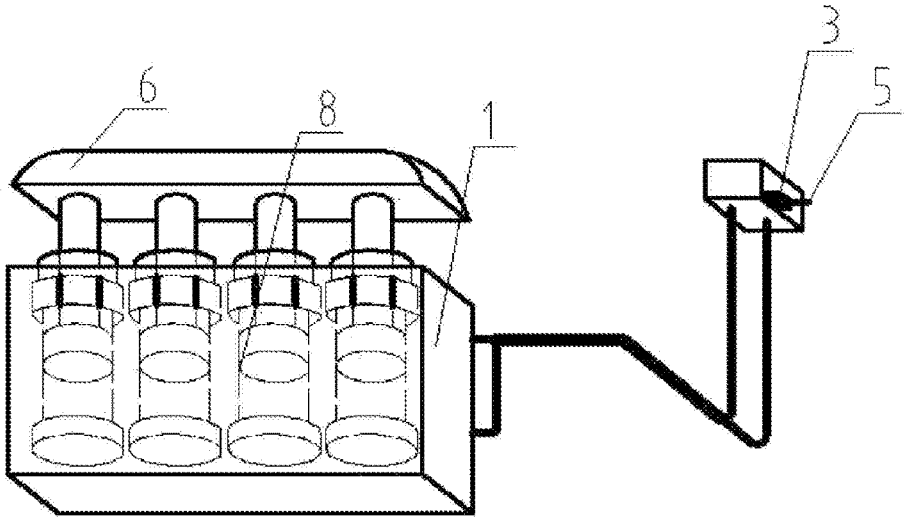
FIG. 1 is a view of the piston-type speed bump structure apparatus in accordance with the present disclosure.
Figure 2:
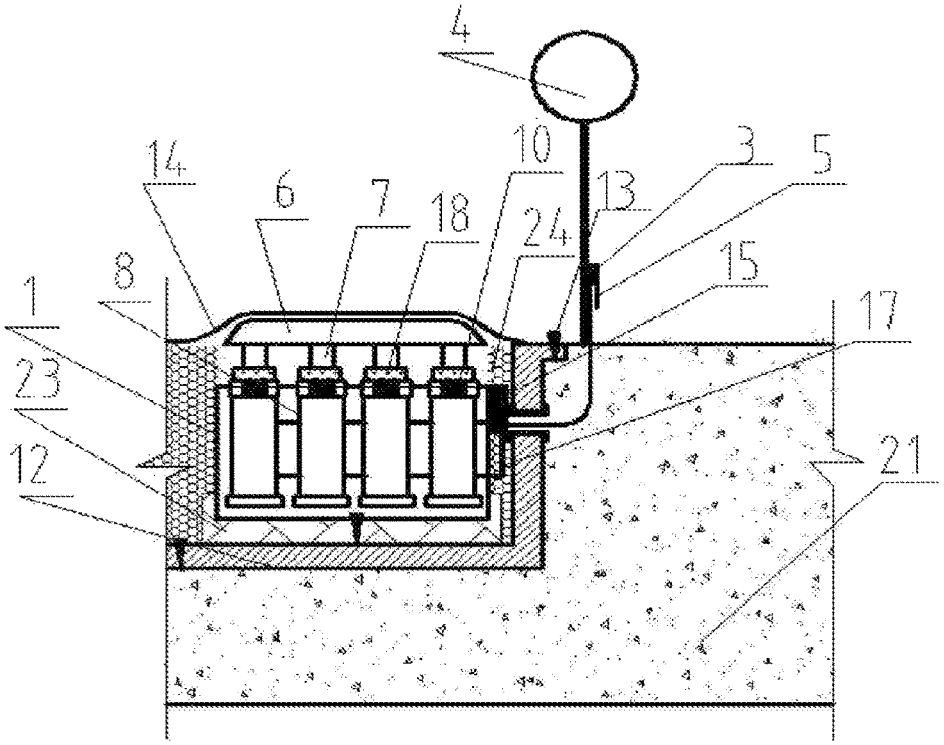
FIG. 2 is a front view of the piston-type speed bump structure apparatus.
Figure 3:
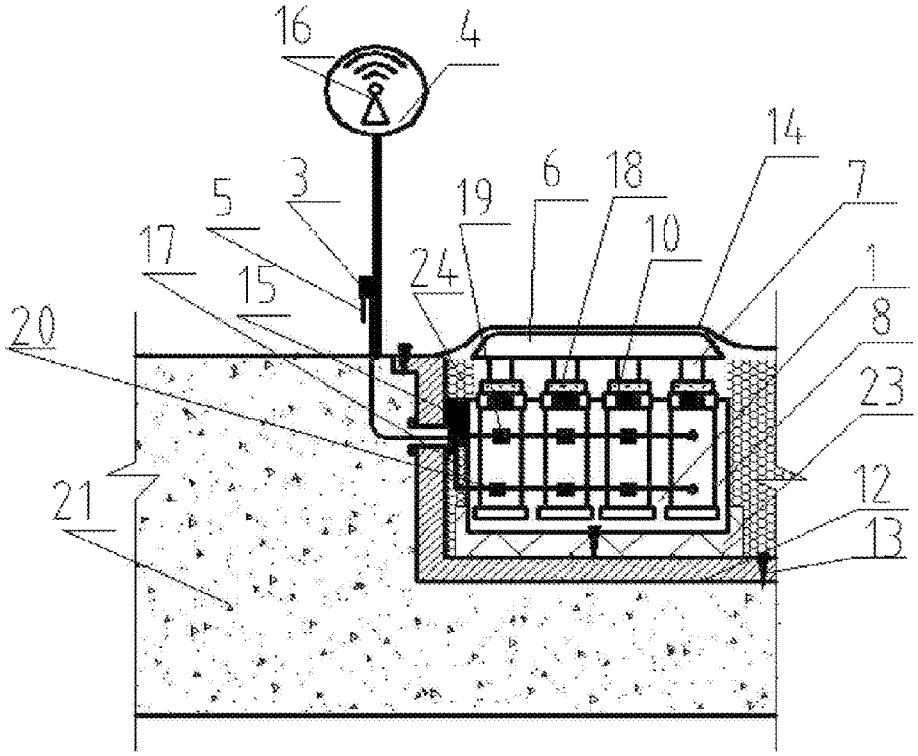
FIG. 3 is a back view of the piston-type speed bump structure apparatus.
Figure 4:
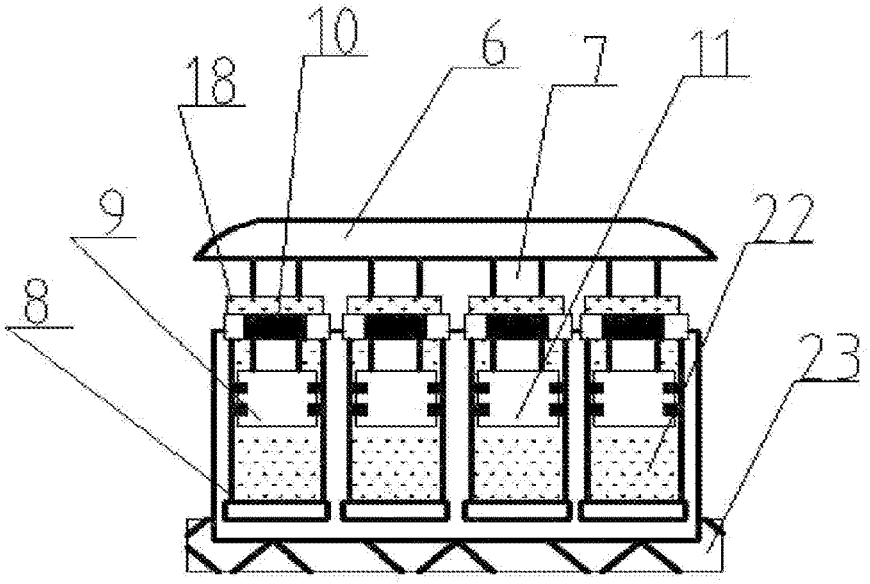
FIG. 4 is a sectional view of the piston-type speed bump structure apparatus.

Components labeled by numeral references in the drawings:1—piston-type speed bump structure apparatus, 2—vehicle speed detection device, 3—speed controller, 4—display screen, 5—an electrical power supply, 6—ridge platform, 7—piston rods, 8—fluid cylinders, 9—pistons, 10—colloid seal ring, 11—piston ring, 12—steel protective layer, 13—pin, 14—rubber material, 15—pump, 16—signal receiver, 17—pipeline, 18—sponge buffer layer, 19—fluid inlet and outlet I, 20—fluid inlet and outlet II, 21—roadbed, 22—fluid, 23—base, 24—filler.

DETAILED DESCRIPTION OF THE PREFERRED EMBODIMENTS

The present disclosure is described in more detailed below with reference to the attached drawings.

All attached drawings of the present disclosure are schematic drawings, referring to FIG. 1, FIG. 2, FIG. 3 and FIG. 4.

In one embodiment, a piston-type speed control device provided by the present disclosure comprises piston-type speed bump structure apparatuses 1 installed in the traffic lane of a road, a vehicle speed detection device 2, a speed controller 3, a display screen 4, and an electrical power supply 5. Piston-type speed bump structure apparatuses 1 and vehicle speed detection device 2 are communicatively connected with speed controller 3, respectively, and speed controller 3 is further connected with display screen 4 and electrical power supply 5.

In one embodiment, three sets of piston-type speed bump structure apparatuses 1 are installed on each traffic lane.

In each of the piston-type speed bump structure apparatuses 1 a ridge platform 6 is covered with a yellow and black striped rubber material 14 and is raised on the road surface at its initial state. A plurality of pistons 9, a plurality of piston rods 7 and a plurality of fluid cylinders 8 are placed under the ridge platform 6. Ridge platform 6 is connected with pistons 9 via piston rods 7. Each of pistons 9 is contained in a respective one of the sealed fluid cylinders 8. A rubber seal ring 10 is placed at the joint point of each of piston rods 7 and each of fluid cylinders 8. A piston ring 11 is placed on each of the pistons 9. A fluid inlet and outlet port 19 and a fluid inlet and outlet port 20 at the side surface of each of fluid cylinders 8 are connected with a pump 15 by a pipeline 17. Pump 15 is connected with electrical power supply 5 through speed controller 3. Vehicle speed detection device 2 is connected with speed controller 3 via a wireless signal receiver 16.

The height of ridge platform 6 of piston-type speed bump structure apparatuses 1 is controlled to cause the same jolting motion to different speeding vehicles. Controlling the ridge platforms 6 of multiple piston-type speed devices can cause jolting motion to the front wheels, the rear wheels, or a single wheel of a vehicle.

A filler 24 is filled in the speed control device. The top of each piston-type speed ridge structure apparatus 1 is covered with an adhesive sponge buffer layer 18. A steel protective layer 12 is placed between the ground and base 23 of each piston-type speed bump structure apparatus 1. Piston-type speed bump structure apparatuses 1 are fixed with steel protective layer 12 through base 23, and steel protective layer 12 is fixed in a roadbed 21 via pins 13 to reduce vehicle impact on the piston-type speed bump structure apparatuses 1, thereby enhancing the durability of the device.

The parameters of display screen 4 can be modified manually or by a network to restrict vehicle speed, alert a driver to slow down, and to drive safely.

Figure 5:
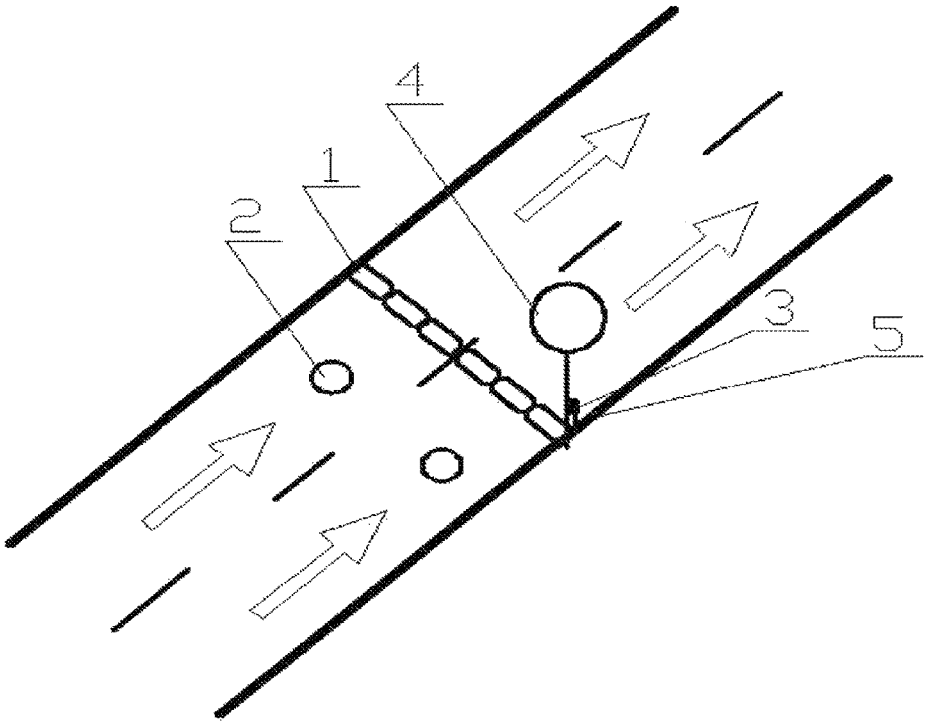
FIG. 5 is a schematic view of vehicle driving direction on a roadway.
Figure 6:
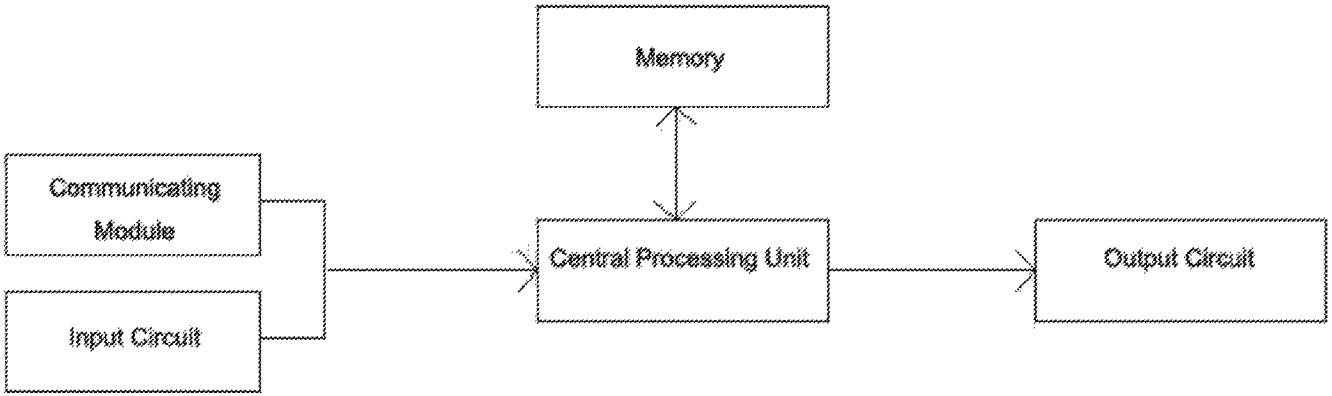
FIG. 6 is a block diagram of a speed controller in accordance with the present disclosure.
Figure 7:
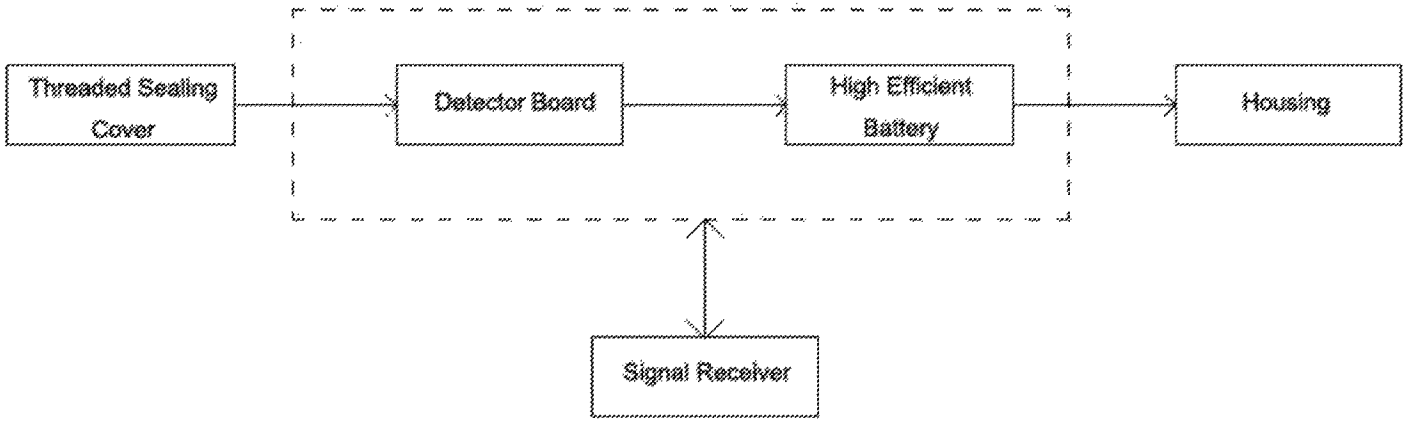
FIG. 7 is a block diagram of a vehicle speed detection device in accordance with the present disclosure.

Referring to FIG. 5, FIG. 6 and FIG. 7, when a vehicle passes through the ground loop in vehicle speed detection device 2 of the present disclosure, the detection board in the ground loop can detect the speed of the passing vehicle in real time and then transmits the detected value to a communication module in the speed controller through a signal receiver. An input circuit collects the transmitted data and the date in the display screen, and stores the collected vehicle speed and speed limit in a memory. A central processing unit reads the data in the memory to process and to decide whether to switch on an external electric source via an output circuit. When the speed of a vehicle exceeds the speed limit set by the present disclosure, speed controller 3 disconnects electrical power supply 5. As a result fluid 22 in the lower parts of pistons 9 in fluid cylinders 8 pushes against pistons 9, and thus the ridge platform 6 cannot be pushed down. Thus the vehicle receives an obvious jolting motion when passing through. When a vehicle passes through the ridge platforms 6 under the speed limit, speed controller 3 connects electrical power supply 5 to supply appropriate current to pump 15. As a result fluid 22 in the lower parts of pistons 9 in fluid cylinders 8 flows into the upper parts of fluid cylinders 8 from fluid inlet and outlet port 20 through pump 15. Pump 15 is connected with fluid inlet and outlet port 19, so that ridge platform 6 is pushed down. Thus the vehicle can pass smoothly with no jolting motion. By controlling the height of ridge platform 6, speed controller 3 can cause jolting motion to the front wheels, the rear wheels, or a single wheel of a speeding vehicle. The present disclosure not only reminds a speeding driver to slow down, but also reduces impact on vehicles passing under the speed limit and minimizes damage to the vehicle. The present disclosure therefore provides a user-friendly design of a speed control device.

A method of installation of the speed control device comprises the steps of transversely installing the speed control device provided by the present disclosure on an urban road and determining the quantity and the length of the piston-type speed bump structure apparatuses according to the width of the road. The surface of the speed control device is covered by rubber material and it creates the same or stronger visual effect as other speed bumps installed on a road to alert a driver to slow down and to drive safely.

According to the above design approach, the speed control device can be installed as described below.

For example, for a 3.5-meter wide traffic lane, three sets of the piston-type speed bump structure apparatuses may be transversely installed on a traffic lane, along the traffic flow direction and a 1150 mm×350 mm ridge platform is chosen for this installation. The length and width of the steel protective layer inside the speed control device is determined according to the piston-type speed bump structure apparatuses and the steel protective layer is fixed on the roadbed with pins. The speed control device can be independently installed. A speed detection device 2, a speed controller 3, and a display screen 4 need to be installed on each traffic lane. When an approaching vehicle is not speeding, which is determined by the speed detection device, the ridge platforms 6 are pushed down to the same level as the road by the passing vehicle and the vehicle passes through smoothly. For a speeding vehicle, the fluid in the fluid cylinders of the piston-type speed bump structure apparatuses pushes against the pistons to cause obvious jolting motion to the vehicle. After the passage of a vehicle the speed control device continues to monitor following vehicles. This process repeats continuously.

What is claimed is:

1. A piston-type variable-speed control device, comprising:

a plurality of piston-type speed bump structure apparatuses installed on a road surface;

a vehicle speed detection device;

a speed controller communicatively connected with the plurality of piston-type speed bump structure apparatuses and the vehicle speed detection device, respectively; and an electrical power supply connected to the speed controller, wherein:

each of the piston-type speed bump structure apparatuses comprises a ridge platform having a surface covered with a yellow-and-black-striped rubber material, the ridge platform being raised above the road surface at an initial state of the piston-type variable-speed control device, a plurality of pistons and a plurality of piston rods and a plurality of fluid cylinders are placed under the ridge platform, the ridge platform is connected with the pistons via the piston rods, each of the pistons is contained in a corresponding one of the fluid cylinders, a rubber seal ring is placed at a joint of each of the piston rods and a corresponding one of the fluid cylinders, a piston ring is placed on each of the pistons, a fluid inlet and a fluid outlet that are located at a side surface of each of the fluid cylinders are connected with a pump by a pipeline, each of the fluid cylinders is connected with a fixed base, the fluid cylinders, the pipeline, and the pump are filled with a fluid, a movement of the pistons is controlled by the fluid, the pump is connected with the electrical power supply through the speed controller, and the vehicle speed detection device is connected with the speed controller via a wireless signal receiver.

2. The piston-type variable-speed control device of claim 1, wherein a speed limit is set by the piston-type variable speed control device in real time, wherein the piston-type variable speed control device causes a jolting motion to a vehicle exceeding the speed limit, and wherein the piston-type variable speed control device allows a vehicle traveling below the speed limit to pass smoothly.

3. The piston-type variable-speed control device of claim 1, wherein a height by which the ridge platform is raised, a time to raise the ridge platform, and a duration for which the ridge platform is raised are controllable to cause a jolting motion to one or more front wheels, one or more rear wheels, or a single wheel of a speeding vehicle.

4. The piston-type variable-speed control device of claim 1, further comprising:

a display screen connected to the speed controller.

5. The piston-type variable-speed control device of claim 3, wherein parameters of the display screen are configured to be modified at least one of manually and remotely through a network.

6. A piston-type variable-speed control device, comprising:

a plurality of piston-type speed bump structure apparatuses installed on a road surface;

a vehicle speed detection device;

a speed controller communicatively connected with the plurality of piston-type speed bump structure apparatuses and the vehicle speed detection device, respectively; and an electrical power supply connected to the speed controller, wherein a filler is disposed between each of the piston-type speed bump structure apparatuses and the speed controller, wherein a top side of each of the piston-type speed bump structure apparatuses is covered with an adhesive sponge buffer layer, wherein the piston-type speed bump structure apparatuses are fixed on a base, wherein a steel protective layer is placed underneath the base, and wherein a pin is used to connect the base to the steel protective layer.

7. The piston-type variable-speed control device of claim 6, wherein a speed limit is set by the piston-type variable speed control device in real time, wherein the piston-type variable speed control device causes a jolting motion to a vehicle exceeding the speed limit, and wherein the piston-type variable speed control device allows a vehicle traveling below the speed limit to pass smoothly.

8. The piston-type variable-speed control device of claim 6, wherein each of the piston-type speed bump structure apparatuses comprises a ridge platform, and wherein a height by which the ridge platform is raised, a time to raise the ridge platform, and a duration for which the ridge platform is raised are controllable to cause a jolting motion to one or more front wheels, one or more rear wheels, or a single wheel of a speeding vehicle.

9. The piston-type variable-speed control device of claim 6, further comprising:

a display screen connected to the speed controller.

10. The piston-type variable-speed control device of claim 7, wherein parameters of the display screen are configured to be modified at least one of manually and remotely through a network.

* * * * *